US007008016B1

(12) United States Patent
Carlo

(10) Patent No.: US 7,008,016 B1
(45) Date of Patent: Mar. 7, 2006

(54) RANGE OF MOTION EXERCISE CHAIR

(76) Inventor: Fred Carlo, 4335 Knights Academy Rd., Valdosta, GA (US) 31601

( * ) Notice: Subject to any disclaimer, the term of this patent is extended or adjusted under 35 U.S.C. 154(b) by 6 days.

(21) Appl. No.: 10/762,363

(22) Filed: Jan. 23, 2004

(51) Int. Cl.
*A47D 13/10* (2006.01)

(52) U.S. Cl. ..... 297/281; 297/DIG. 4; 297/DIG. 10; 297/325

(58) Field of Classification Search ..... 297/281, 297/282, 259.2, 259.1, 259.3, 258.1, 270.1, 297/271.1, DIG. 10, DIG. 4, 130, 256.13, 297/273, 280, 325; 482/142, 148
See application file for complete search history.

(56) References Cited

U.S. PATENT DOCUMENTS

| | | | | |
|---|---|---|---|---|
| 2,044,862 | A | 6/1936 | Smith | |
| 2,271,440 | A | 1/1942 | Nelems | |
| 2,311,482 | A | 2/1943 | Smith | |
| 2,683,481 | A | 7/1954 | Lorenz | |
| 3,994,468 | A | 11/1976 | Carter et al. | |
| 4,213,650 | A | 7/1980 | Sroub | |
| 4,796,949 | A * | 1/1989 | Boyce | 297/259.3 |
| D328,197 | S | 7/1992 | Braxton, III | |
| 5,163,188 | A * | 11/1992 | Munroe | 5/81.1 R |
| D350,855 | S | 9/1994 | Pomeroy et al. | |
| 5,556,121 | A * | 9/1996 | Pillot | 280/304.1 |
| 5,667,273 | A | 9/1997 | Noll | |
| 5,746,478 | A * | 5/1998 | Lumley et al. | 297/256.13 |
| 6,120,094 | A | 9/2000 | Parent | |
| 6,189,164 | B1 * | 2/2001 | Krapu | 4/667 |
| 6,213,551 | B1 | 4/2001 | Desnoyers et al. | |
| 6,464,295 | B1 | 10/2002 | Bergeron et al. | |
| 6,695,401 | B1 * | 2/2004 | Noll | 297/281 |

* cited by examiner

*Primary Examiner*—Milton Nelson, Jr.
(74) *Attorney, Agent, or Firm*—Dowell & Dowell, P.C.

(57) ABSTRACT

A seating device including a seating unit movably suspended relative to a primary frame so that an individual can grasp at least one handle connected to the primary frame to create desired motion between the seating unit and the primary frame. A lock bar controlled by the individual is selectively operable to engage an element of the seating unit to prevent motion between the seating unit and the primary frame. The primary frame may be supported on wheels to form an exercise wheelchair.

14 Claims, 4 Drawing Sheets

FIG. 4
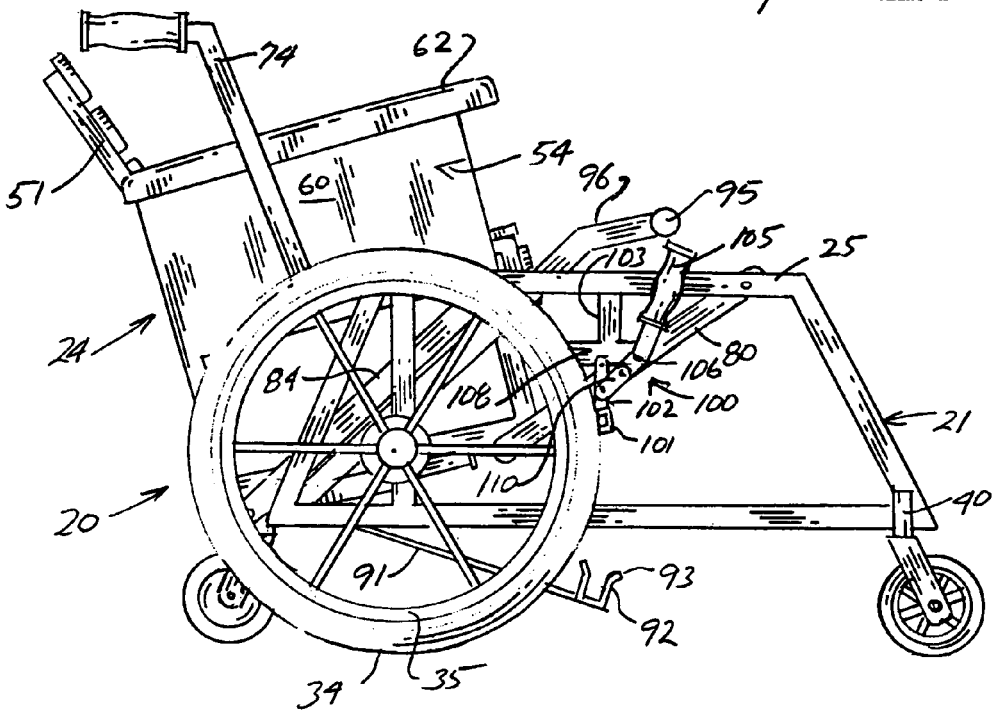
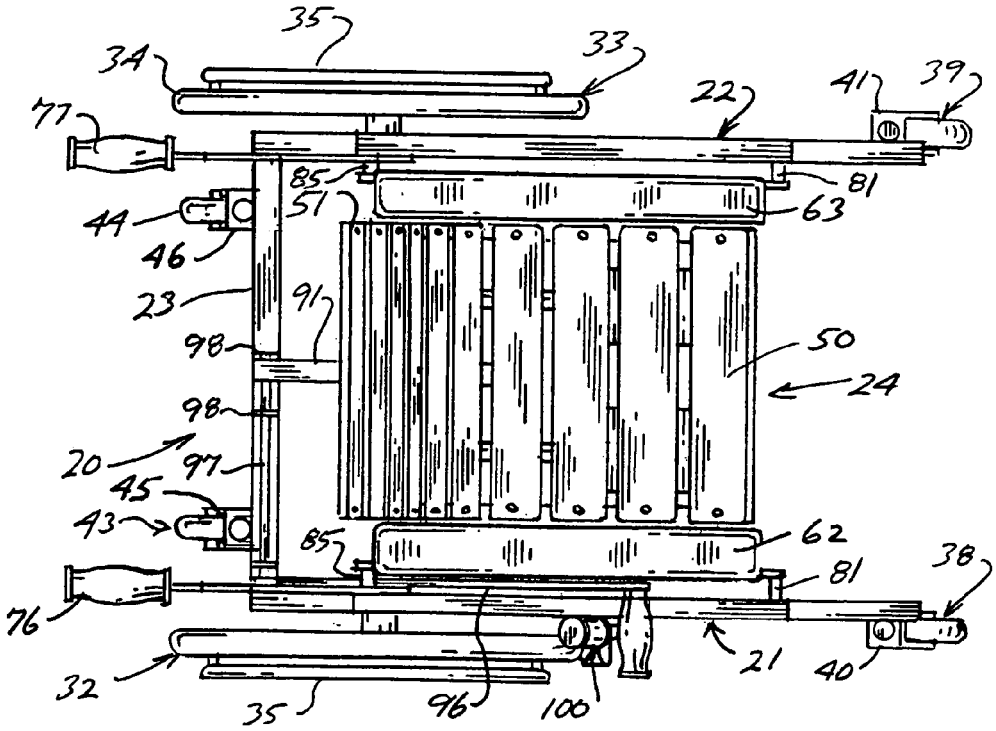
FIG. 5

RANGE OF MOTION EXERCISE CHAIR

BACKGROUND OF THE INVENTION

1. Field of the Invention

This invention is directed to a range of motion exercise seating device in the form of a stationary chair or wheelchair and wherein a seat unit of the device may be moved by an individual seated therein in a rocking, swinging or gliding motion relative to a primary frame to which the seat unit is mounted.

2. Brief Description of the Related Art

There have been numerous innovations directed to improving individual seating structures to facilitate an individual's health and comfort as well as to increase the utility and ease of use of such structures. By way of example, seating structures have been designed to promote health by permitting either active or passive muscle movements to facilitate healing and/or to promote a patient's circulation. Some such seating structures are designed to allow an individual to control a rocking, gliding or swinging motion of a chair relative to a support to thereby provide a means for generalized exercise as well as to provide a form of relaxation. Some of these gliding, rocking or swinging type structures also include means for limiting or preventing seat movement to provide stability when an individual is being seated or when rising from a seated position.

Many individuals lack sufficient strength to sit or stand without assistance. Therefore, other seating devices have been designed to include components for assisting an individual to either be seated from a standing position or to rise or stand from a seated position. Other seating devices include structures that are convertible from stationary seating units to mobile or movable units such as wheelchairs. Such convertibility provides increased utility for a seating unit whereby an individual who is not ambulatory can be moved either by their own strength or by assistance from others.

Unfortunately, many prior art seating structures which are designed for multi-purpose uses are often too complex to be easily usable and/or are to costly to be readily available for those with limited economic resources or without necessary health insurance. Therefore, there is a need to provide a seating device that is economic to produce and yet which can be used for limited active exercise by creating motion of a seat relative to a support frame to promote user health through stimulation of circulation, muscles, and neurocirculation and neuromuscular systems. There is also a need to provide such a seating device that can further be locked to provide for a stable seating unit and that is also adapted to be converted quickly for wheelchair use and which also provides an additional utility of being capable of functioning as a seat assist device.

SUMMARY OF THE INVENTION

The present invention is directed to a seating device which includes a seating unit which may be selectively moved using one or more fixed handles mounted to a primary support frame in a rocking, gliding or swinging motion relative to the primary support frame by an individual seated within the seating unit as a form of exercise, stimulation and/or relaxation. The seating unit is mounted by pivotal linkage members relative to the primary frame and a lock bar is movably mounted to the primary support frame and is selectively engageable with a portion of the seat frame to thereby prevent relative motion between the seating unit and the primary support frame.

In one embodiment, the linkage system between the seating unit and the primary support frame may also allow the seating unit to be elevated and tilted forwardly so as to provide a seat assist to aid an individual being seated or to assist an individual to rise from a seated position.

In yet a further embodiment of the invention, the primary support frame of the seating unit may be mounted on wheels including two large diameter rear wheels and two sets of smaller diameter front and stabilizing rear wheels whereby the seating device may be converted into a wheelchair. The wheelchair may also include adjustable foot rests which are movably with respect to brackets mounted to the frame of the seating unit.

It is the primary object of the present invention to provide a seating device which can be used as a stationary seat or a movable exercise chair.

It is another object of the present invention to provide a seating unit which can be mounted on wheels such that the device can easily be converted to a wheelchair.

It is also an object of the present invention to provide a seating device including a seating unit mounted as a glider with respect to a primary support frame wherein the seating unit can be selectively locked to prevent relative movement between the seating unit and the primary support frame.

BRIEF DESCRIPTION OF THE DRAWINGS

A better understanding of the invention will be had with respect to the accompanying drawings wherein:

FIG. 4 is a right side view of the wheelchair shown in FIG. 2 showing a range of motion to the rear of the primary support frame of the seating unit when used in a gliding or rocking motion;

FIG. 5 is a top plan view of the wheelchair shown in FIG. 1;

DESCRIPTION OF THE PREFERRED EMBODIMENTS

With continued reference to the accompanying drawings, the invention will be described with respect to two embodiments of range of motion exercise seating devices. In the embodiment shown in FIGS. 1 through 5 the seating device is shown in the form of a wheelchair whereas in FIGS. 6 and 7, the seating device is shown in the form of a stationary chair. In each embodiment, the primary components of the chairs are essentially the same and offer the same benefits with respect to exercise and therapeutic use. Further, each of the embodiments is also adapted to provide a seat assist orientation of a seating unit to further facilitate the use of the seating devices.

Figure 1:
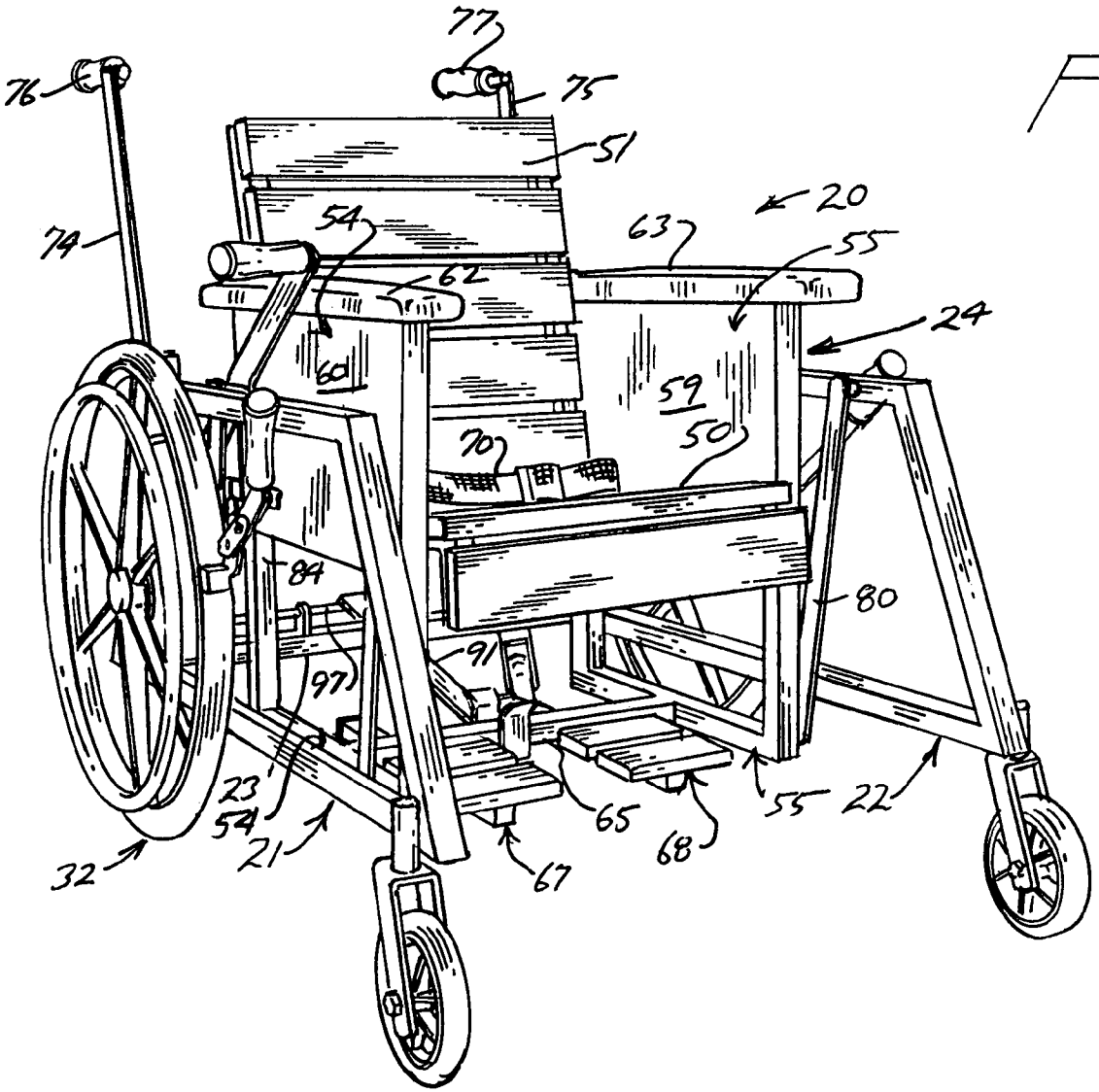
FIG. 1 is a front perspective view of a range of motion exercise seating device in the form of a wheelchair in accordance with the teachings of the present invention.

In FIG. 1, a wheelchair 20 is shown having two generally identical primary trapezoidal side frame components 21 and 22 which are spaced on opposite sides of a seating unit 24. The side frame components 21 and 22 are joined by at least one cross brace 23. The primary frame components are preferably formed of a metal tubing which may be rectangular or square in cross-section as shown in the drawing figures, although other configurations may be used.

Each of the primary side frame components 21 and 22 includes an upper frame member 25 and elongated lower frame member 26 which are connected by an angled front frame member 27 and a rear angled frame member 28.

In the embodiment shown in drawing FIGS. 1 through 5 in the form of a wheelchair, a further vertical frame member 29 extends from the upper frame member 25 to the lower frame member 26 and supports a bearing assembly 30 to which one of a pair of wheels 32 and 33 is rotatably secured. Each of the wheels 32 and 33 may be formed with a pneumatic or solid rubber type tire 34 from which extends a hand engageable annular ring 35 for purposes of manually rotating the wheels in a conventional manner.

Each of the primary side frame components 21 and 22 is further supported adjacent the front thereof by wheel assemblies 38 and 39 each of which is pivotally mounted within mounting sockets 40 and 41, respectively, so as to be pivotable. To provide stability, each of the side frame components 21 and 22 is further supported adjacent the rear end thereof by stabilizing wheel assemblies 43 and 44, that are also pivotally to mounting sockets 45 and 46 connected to the cross brace 23. The wheelchair of the present invention may be rapidly converted to a stationary exercise chair by removably mounting the wheels and wheel assemblies to the primary frame components 21 and 22. By way of example, each of the wheel assemblies may be frictionally locked within their relative sockets or the support sockets may be mechanically attached to the frame components so as to be readily detached.

In the embodiment shown in FIGS. 1 through 5, the rear stabilizing wheels are shown to be angled toward the rear of the wheelchair 20 such that tipping of the wheelchair rearwardly is effectively prevented as the seating unit 24 is used in a rocking or gliding motion, as will be described in greater detail.

The seating unit 24 is shown including a seat 50 and a backrest 51 which are securely mounted to a seat frame consisting of side seat frame components 54 and 55 which are generally tubular components of rectangular or square cross section. Each of the seat frame side components includes a front vertical frame member such as shown at 56 in FIG. 3 and a rear vertical frame member 57 which extend between a base frame component 58 and an upper horizontal frame component which, in the drawing figures, is obscured by inner and outer panels 59 and 60 which cover the upper portion of the side frame components.

Armrests 62 and 63 are mounted to each of the upper portions of the seat frame components as is shown in the drawing figures. The seat frame is preferably formed of the same tubular metal stock as the primary frame components. The seat and backrest 50 and 51 are shown in the drawings figures to include a plurality of slat members which are generally spaced from one another to allow circulation therebetween. However, any type of seating materials may be used, and cushioned pads and other types of seat structures may be included within the teachings of the invention.

As shown in FIG. 1, to structurally reinforce the seating unit side frame components 54 and 55, at least one cross brace member 65 is welded or otherwise secured at the base of each of the frame components.

Figure 3:
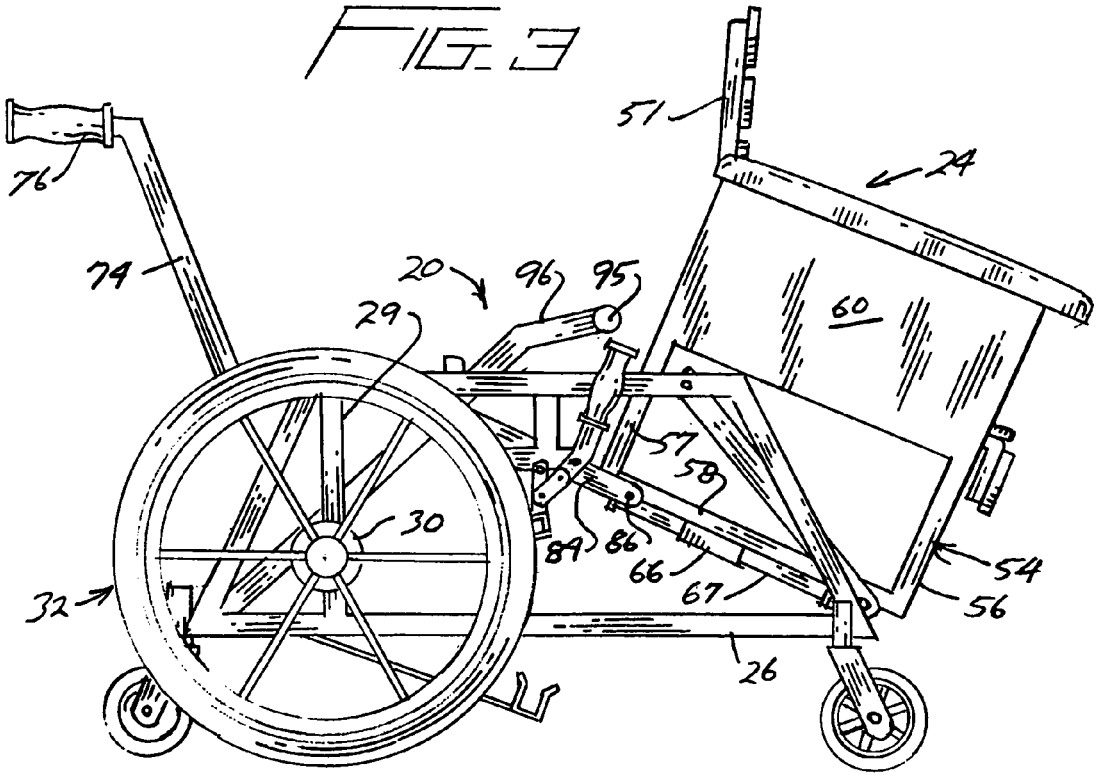
FIG. 3 is a right side view of the wheelchair shown in FIG. 2 with a seating unit thereof being extended in a seat assist orientation.

In the embodiment shown, a pair of mounting brackets 66, see FIG. 3, are secured to the cross brace member 65 and slidingly support a pair of spaced footrest members 67 and 68, see FIG. 1, such that the footrest members may be reciprocally extended or retracted relative to the seat 50, depending upon preference of an individual seated within the wheelchair. The footrests are shown in a fully retracted position in FIG. 1 but may be extended forwardly of the seat by engaging the footrests and urging them forwardly. To provide for safety, the seating device may also include a seatbelt shown at 70.

In the present embodiment, to allow the wheelchair to be operated by a third party, a pair of elongated handles 74 and 75, each having a hand grip 76 and 77, respectively, are secured to the primary side frame components 21 and 22, as shown in FIG. 5 of the drawing figures. It is preferred that the handles 74 and 75 be removably secured to the primary support frame as such handles will not be required in all instances.

The present invention is directed to providing a range of motion type structure for either a wheelchair or a stationary chair such that the seating unit 24 may be used as a form of exercise, stimulation and/or therapy. In this respect, the seating unit is suspended relative to the side frame components 21 and 22 by linkage members provided on opposite sides of the seating unit. In the embodiment shown, linkages 80 are pivotally mounted at 81 to the front upper portion of the primary support frames and pivotally mounted at 82 to the front lower portions of the seat frame. Further, rear linkages 84 are provided which are pivotally connected at 85 to the rear upper portions of the primary support frame components and pivotally mounted at 86 to the rear lower portions of the seat frame, see FIGS. 2 and 5.

As opposed to pivotally mounting the upper portion of each of the linkages 80 and 84 to the upper portion of the primary frame components, a reverse connection may be used to moveably support the seating unit relative to the primary support frame components. Thus, the linkages 80 may be pivotally mounted at their lower end to a lower member of the primary frame component with their upper end pivotally connected to an upper portion of the frame of the seating unit. In either case, a suspended and movable relationship is established between the seating unit and the primary support frame components.

Figure 2:
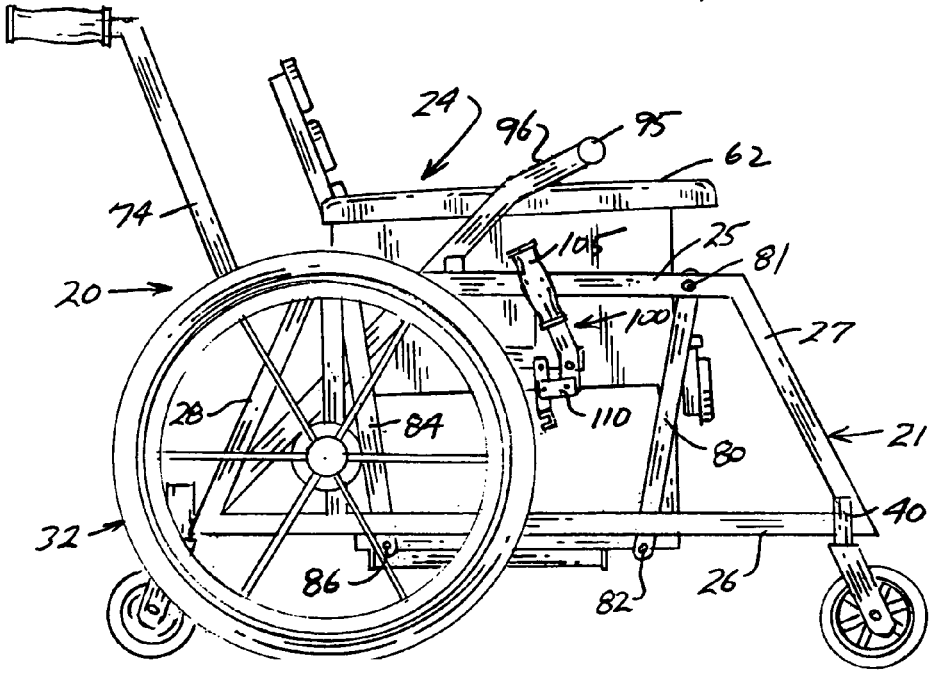
FIG. 2 is a right side view of the wheelchair shown in FIG. 1.

As shown in FIG. 2, the linkages 80 are slightly diagonally oriented rearwardly from top to bottom relative to the seating unit 24 whereas linkages 84 are slightly diagonally oriented forwardly from top to bottom. With this orientation, when the seating unit is moved forwardly to its full extent, the seating unit is tilted downwardly and forwardly as shown in FIG. 3. This provides a seat assist orientation to facilitate an individual either being seated in the chair or to assist an individual when rising from a seated position.

When an individual is being seated within the wheelchair, the seat may be oriented forwardly as shown in FIG. 3 and thereafter moved rearwardly to the position shown in FIG. 2. Because of the suspended linkage system provided between the seating unit and the primary side frame components, the seating unit may also be rocked rearwardly relative to the frame components as shown in FIG. 4. In this event, the stabilization wheels 43 and 44 prevent any tipping of the wheelchair rearwardly as weight is transferred to the rear portion of the primary frame components.

From the foregoing description, the seating unit 24 may be moved in a rocking, swinging or gliding motion forwardly or rearwardly due to the suspended nature of the seating unit relative to the primary side frame components. To prevent relative motion between the seating unit and the primary side frame components, the present invention provides a locking assembly which includes a lock bar 91 having a outer generally u-shaped engaging member 92 secured therewith. The engaging member 92 is of a size to selectively receive the cross brace 65 with the outer ends of the engaging member 92 being flared outwardly as shown at 93 in drawing FIG. 4 to facilitate alignment of the member when being moved into engagement with the cross brace 65, as shown in FIG. 1. With the lock bar 91 in the position shown in FIG. 1, relative motion between the seating unit 24 and the primary side frame components is prevented.

The locking assembly further includes a lock bar handle 95 mounted to a linkage 96 which is connected at its lowermost end to a rotatable pivot rod 97. The pivot rod 97 is mounted within spaced bearings 98, See FIG. 5, and the lock bar 91 is secured thereto so as to be pivotal therewith. When the lock bar handle 95 is in a first position as shown in FIG. 1, the lock bar 91 is raised such that the u-shaped engaging member engages the cross brace 65 of the seat frame to prevent relative movement between the seat and the primary support frame. By pushing the lock bar handle 95 forwardly, the pivot rod 97 is pivoted to move the lock bar 91 to a second position, as shown in FIG. 4, thereby allowing relative movement between the seating unit and the primary support frame in a rocking, swinging or gliding motion due to the suspension linkage connection between the seat frame and the primary support frame.

To prevent movement of the wheelchair 20 when the seat is to be used in an exercise or therapeutic rocking or gliding mode, a lock assembly 100 is provided for engaging one of the large wheels 32. As is shown, a brake pad 101 is carried by a pivot arm 102 connected to a brace 103 welded to the upper member 25 of the primary support frame 21. A brake handle 105 is pivotally connected at 106 to a further frame component 108 secured to the brace 103. By pivoting the brake handle 105, the brake may be selectively engaged with the tire or wheel 33 of the wheel 32 to prevent relative motion. Further, the brake assembly includes an over-center mechanical lock 110 which retains the brake pad 101 against the tire until intentionally released by movement of the brake handle 105.

In the locked position, the brake handle can be engaged by an individual seated within the seat so that a force can be applied against the brake handle for leverage in creating a rocking, swinging or gliding motion of the seating unit. When it is desired to release the lock to use the wheelchair in a conventional manner, the brake handle is moved in the opposite direction to release the brake pad 101 from the wheel 32.

As opposed to using the brake handle as a means for leverage to create a range of motion of the seating unit, a separate operating handle may be provided on either of the primary frame components 21 and 22 which is fixed relative thereto so the operating handle may be selectively engaged and force applied to create a swinging, rocking or gliding motion of the seat.

In view of the foregoing, the embodiment of the invention shown in FIGS. 1 through 5 may be selectively used as a conventional wheelchair by engaging the member 92 with the cross bar 65 of the seat frame. When it is desired to use the wheelchair as an exercise or therapy chair, the lock bar mechanism is moved to its second or released position thus allowing a rocking or gliding motion of the seating unit relative to the primary support frame.

As previously described, by extending the seat completely forward, the linkage assembly which supports the seat support frame member will tilt the seat forwardly as shown in FIG. 3 to thereby make it easier for a person to stand from a seated position or to be lowered to a seating position from a standing position.

Figure 6:
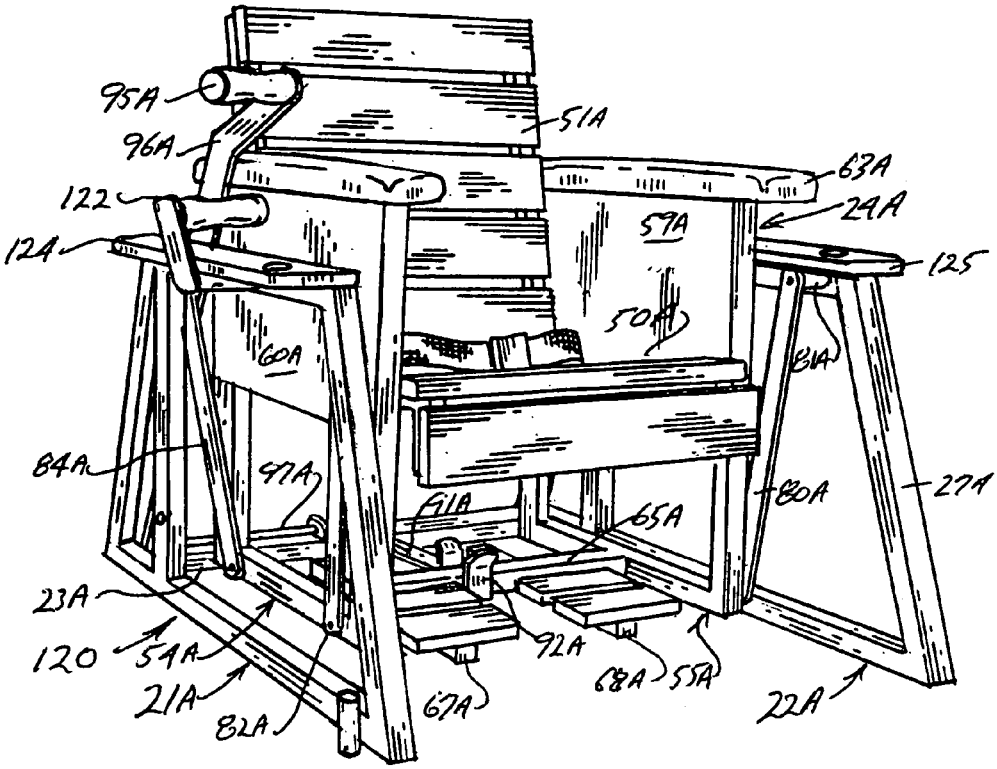
FIG. 6 is a front perspective view of a range of motion exercise seating device in the form of a stationary chair in accordance with the teachings of the present invention.
Figure 7:
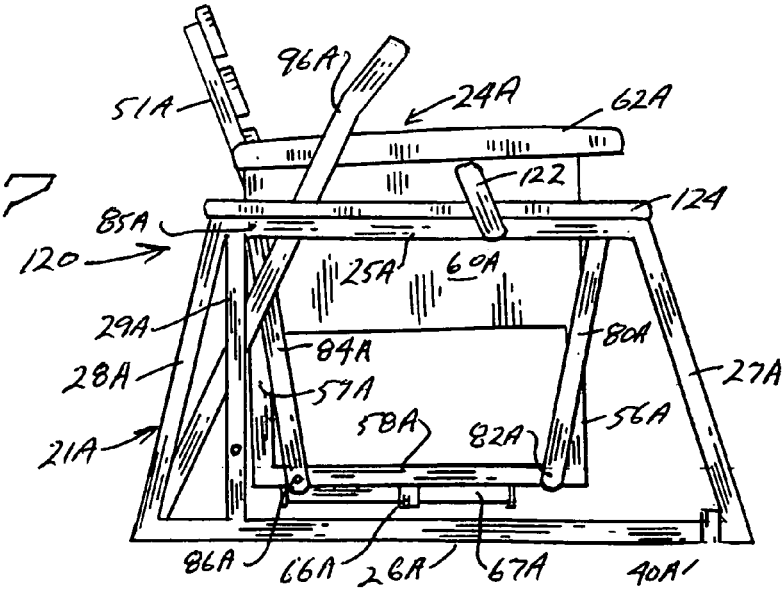
FIG. 7 is a right side view of the stationary chair shown in FIG. 6.

With particular reference to FIGS. 6 and 7, a second embodiment of the invention is shown in detail. In this embodiment, the range of motion exercise seating device is in the form of a stationary chair 120. The chair includes most of the same elements which are associated with a wheelchair. As previously described, it is possible that the stationary chair may easily be converted to a wheelchair by the addition of the wheels and wheel assemblies of the wheelchair embodiment. Further, the seating device of this embodiment provides a range of motion exercise by allowing the seat to be rocked in a swinging or gliding motion as described with respect to the wheelchair. The components of the stationary chair will be assigned the same number with the suffix "A" as the components relate to the embodiment of the wheelchair.

The stationary chair 120 therefore includes primary trapezoidal side frame components 21A and 22A which are spaced on opposite sides of a seating unit 24A. The side frame components 21A and 22A are joined by at least one cross brace 23A. The primary frame components are preferably formed of a metal tubing which may by rectangular or square in cross-section as shown in the drawing Figures, although other configurations may be used.

Each of the primary side frame components 21A and 22A includes upper an frame member 25A and an elongated lower frame member 26A which are connected by an angled front frame member 27A and a rear angled frame member 28A. As with the wheelchair embodiment, a further vertical frame member 29A may be provided which extends from the upper frame member 25A to the lower frame member 26A. In some instances, this vertical member may be omitted from the stationary chair if the stationary chair is not to be convertible to a wheelchair.

For those embodiments where the stationary chair is designed to be specifically convertible to a wheelchair, mounting sockets such as shown at 40A will be provided on the stationary chair for purposes of allowing an easy assembly of the wheels such as described at 38 and 39 in the previous embodiment. In those embodiments where the stationary chair is not to be convertible, the mounting sockets such as shown at 40A need not be provided on the stationary chair.

The stationary chair 120 further includes a seating unit 24A having a seat 50A and backrest 51A which are securely mounted to a seat frame consisting of side seat components 54A and 55A which are formed of generally tubular members of rectangular or square cross section. Each of the seat frame side components includes a front vertical frame member 56A and rear vertical frame member 57A which extend between a base frame component 58A and upper horizontal frame component (not shown). Side panels 59A and 60A cover the upper portion of the side frame components. Armrests 62A and 63A are mounted to each of the upper portions of the seat frame components. The seat frame is preferably formed of the same tubular metal stock as the primary frame components. The seat and backrest 50 and 51 are also shown to include a plurality of slat members which are generally spaced from one another to allow circulation therebetween. However, as discussed with respect to the previous embodiment, other types of seat and back members including cushioned pads and other materials may be used in accordance with the teachings of the invention.

The seating unit side frame components 54A and 55A are structurally reinforced by at least one cross brace member 65A which is welded or otherwise secured thereto. As shown, a pair of mounting brackets 66A are secured to the cross brace members 65A and slidingly support a pair of spaced foot rests members 67A and 68A. However, in some embodiments, the foot rest need not be provided for the stationary chair. The foot rest may be extended and retracted with respect to the mounting brackets 66A.

As with the previous embodiment, the stationary chair may be used as a form of exercise, stimulation and/or therapy. The seating unit 24A is suspended relative to the side frame components 21A and 22A by linkage members provided on opposite sides of the unit. Linkages 80A are pivotally mounted at 81A to the front upper portion of the primary support frames and pivotally mounted at 82A to the front lower portions of the seat frame. Further, rear linkages 84A are provided which are pivotally connected at 85A to the rear upper portions of the primary support frame components and pivotally mounted at 86A to the lower rear portion of the seat frame.

As opposed to pivotally mounting the upper portion of each of the linkages 80A and 84A to the upper portion of the primary frame components, a reverse connection may be used, as described with respect to the previous embodiment, to support the seat unit relative to the primary support frame components. Therefore, the linkages 80A may be pivotally mounted at their lower end to a lower member of the primary frame component with their upper end pivotally connected to an upper portion of the frame of the seating unit. As previously described, each linkage 80A is slightly diagonally oriented rearwardly from the top to bottom relative to the seat unit 24A whereas linkage members 84A are slightly diagonally oriented forwardly from top to bottom. With this orientation, when the seating unit is moved forward to its full extent, the seating unit is tilted downwardly and forwardly in a position as shown in the embodiment of FIG. 3 thereby providing a seat assist orientation to facilitate an individual being either seated in the chair or when rising from a seated position. Further, because of the suspended linkage system provided between the seating unit and the primary frame components, the seating unit may also be rocked rearwardly relative to the primary frame components in the same manner as shown in the embodiment in FIG. 4.

The seating unit 24A may be moved in a rocking, swinging or gliding motion forwardly or rearwardly due to the suspended nature of the seating unit relative to the primary side frame components. To prevent this relative motion, the present invention provides a locking assembly which includes lock bar 91A having an outer u-shaped engaging member 92A secured thereto. The engaging member 92A selectively engages the cross brace 65A of the seating unit with the outer ends of the engaging member 92A being flared outwardly to facilitate alignment of the engaging member when being moved into engagement with the cross brace 65A, as is shown in FIG. 6. With the lock bar 91A in the position shown in FIG. 6, relative motion between the seating unit 24A and the primary side components is prevented.

The locking assembly further includes a lock bar handle 95A mounted to a linkage 96A which is fixedly connected at its lower end to a pivot rod 97A secured in a manner as described with respect to the previous embodiment. When lock bar handle is in a first position, as is shown in FIG. 5, the lock bar 91A is raised such that the u-shaped engaging member 92 engages the cross brace 65A of the seat frame to prevent relative movement. By pushing the lock bar handle 95A forwardly, the pivot rod 97A is pivoted to move the lock bar 91A to a second position thereby allowing relative movement between the seating unit and the primary support frame.

To allow an individual seated within the stationary chair 120 to apply a force to the seating unit to create a rocking, swinging or gliding motion of the seating unit relative to the primary support frame components, a separate fixed handle 122 may be provided on either of the primary frame components 21A or 22A. In the drawing Figures, the fixed handle is shown as being mounted on the primary frame component 21A. The seating unit is placed in motion by pushing or pulling on the fixed handle.

In this embodiment, separate arm rests 124 and 125 may also be mounted to the top of each of the primary support frames 21A and 22A as is shown in FIG. 6.

The foregoing description of the preferred embodiment of the invention has been presented to illustrate the principles of the invention and not to limit the invention to the particular embodiments illustrated. It is intended that the scope of the invention be defined by all of the embodiments encompassed within the following claims and their equivalents.

I claim:

1. A seating device that may be used for exercise or therapy, the seating device including; a primary frame having opposing and spaced side frame components, a seating unit including a seat and a back mounted to a seat frame, suspension means for movably supporting said seating unit between said side frame components, a lock assembly mounted to said primary frame and including an operating handle mounted adjacent one of said side frame components and a lock bar moveable relative to and beneath said seat, a linkage for connecting said operating handle to said lock bar, whereby when said operating handle is in a first position said lock bar engages said seat frame to prevent relative movement between said seating unit and said primary frame, and when said operating handle is in a second position, said lock bar is disengaged from said seating unit whereby said seating unit is movable relative to said primary frame.

2. The seating device of claim 1 wherein said suspension means includes a pair of spaced link members disposed on each of opposite sides of said seat frame, said link members being pivotally connected at upper ends thereof to one of said seating unit and said side frame components and at lower ends thereof to the other of said seating unit and said side frame components.

3. The seating device of claim 2 wherein each of said pairs of spaced link members are not parallel to one another.

4. The seating device of claim 2 wherein said seat frame includes side frame members, a brace extending between and connecting said side frame members beneath said seat and said lock bar being engageable with said brace to thereby lock said seating unit relative to said primary frame.

5. The seating device of claim 4 including at least one gripping handle mounted to said primary frame adjacent one of said side frame components, said at least one gripping handle being selectively engageable by an individual seated in said seating unit when said operating handle is in said first position to create a force to move said seating unit relative to said primary frame in a swinging or gliding motion.

6. The seating device of claim 5 including an arm rest mounted to each of said side frame members of said seat frame.

7. The seating device of claim 5 wherein a pair of spaced brackets are mounted in spaced relationship to said brace and a pair of reciprocally adjustable foot rests are slidably carried by said brackets so as to be adjustable relative to a forward portion of said primary frame.

8. The seating device of claim 5 wherein said lock bar includes an outer generally u-shaped end for selectively engaging said brace when said operating handle is in said second position.

9. The seating device of claim 5 wherein said pairs of spaced link members are connected to said seating unit such that said seating unit may be tilted forwardly and downwardly relative to said primary frame when moved upwardly and forwardly of said primary frame by manipulation of said at least one gripping handle to thereby provide a lift assist to aid an individual from rising from said seating unit.

10. The seating device of claim 9 including a plurality of wheels for supporting said primary frame whereby the seating device is a wheelchair.

11. The seating device of claim 10 including means for removably mounting said plurality of wheels to said primary frame whereby the seating unit may be used without said plurality of wheels as a stationary chair or with said plurality of wheels as a wheelchair.

12. The seating device of claim 10 wherein a pair of spaced brackets are mounted in spaced relationship to said brace and a pair of reciprocally adjustable foot rests are slidably carried by said brackets so as to be adjustable relative to a forward portion of said primary frame.

13. The seating device of claim 10 including an arm rest mounted to each of said side frame members of said seat frame.

14. The seating device of claim 10 wherein said lock bar includes an outer generally u-shaped end for selectively engaging said brace when said operating handle is in said second position.

* * * * *